US006244659B1

(12) United States Patent
Knapp

(10) Patent No.: US 6,244,659 B1
(45) Date of Patent: Jun. 12, 2001

(54) ERGONOMICALLY DESIGNED CHAIR

(76) Inventor: Herbert A. Knapp, 272 Elm St., Norwich, VT (US) 05055-9444

( * ) Notice: Subject to any disclaimer, the term of this patent is extended or adjusted under 35 U.S.C. 154(b) by 0 days.

(21) Appl. No.: 09/522,701

(22) Filed: Mar. 10, 2000

Related U.S. Application Data

(63) Continuation-in-part of application No. 09/489,656, filed on Jan. 24, 2000, now abandoned.

(51) Int. Cl.[7] ..... A47C 1/02; A47C 1/023
(52) U.S. Cl. ..... 297/317; 297/342
(58) Field of Search ..... 297/317, 320, 297/342, 343, 411.33

(56) References Cited

U.S. PATENT DOCUMENTS 1,414,637 * 5/1922 Gell ..... 297/343 X
3,039,821 * 6/1962 Black et al. ..... 297/343
4,078,841 * 3/1978 Kiang ..... 297/317 X
4,452,486 * 6/1984 Zapf et al. ..... 297/317
4,938,534 * 7/1990 Tornero ..... 297/411.33 X

* cited by examiner

*Primary Examiner*—Anthony D Barfield
(74) *Attorney, Agent, or Firm*—Hopgood, Calimafde, Judlowe & Mondolino

(57) ABSTRACT

A chair ergonomically designed to cause its occupant to assume a sitting posture that acts to distribute the load imposed by the sitter's upper body weight so as to relieve stress on the musculature of the lower back, thereby obviating lower back pain. The seat of the chair is slidable along a track that is upwardly inclined at a fixed angle relative to the structure on which the chair is supported. Hinged to the seat is a backrest that is supported at the rear of the chair. When an individual sits down to place his buttocks on the seat, he then slides the seat along the track until the backrest assumes an angle with respect to the seat at which it is comfortable to the sitter, and the seat is then latched to maintain this orientation. The resultant sitting posture of the individual is such that the load imposed by his upper body weight is to a substantial degree transferred away from the ischeal tuberosities and toward the lower back, where the weight is borne by the vertebral spinous processes, and to the thighs. Additionally, the iliopsosas and other musculature that normally maintains support when standing but is stressed when sitting in a conventional chair or bench is not stressed.

9 Claims, 2 Drawing Sheets

ERGONOMICALLY DESIGNED CHAIR

This application is a continuation-in-part of application Ser. No. 09/489,656, filed Jan. 24, 2000, now abandoned the disclosure of which is incorporated herein by reference for all purposes.

BACKGROUND OF THE INVENTION

1. Field of Invention

This invention relates generally to chairs adapted to accommodate an individual in a manner avoiding adverse physical side effects; and more particularly to a chair ergonomically designed to cause its occupant to assume a sitting posture which obviates undue stress on the lower back and hence avoids lower back pain.

2. Status of Prior Art

Human factors engineering, also known as ergonomics, deals with interaction which take place between an individual and a device or machine he uses or operates. The objective of ergonomic design is to attain an optimum relationship between this individual and the machine or device. Thus in designing a kitchen utensil having a handle, an ergonomic design is one making it possible for an individual who is handicapped to be able to firmly grasp the handle despite the weakness of his grip.

In the ergonomic design of a chair, the objective is not only to provide its occupant with a comfortable seat, for its main goal is to avoid impairment of the occupant's well being. Of primary concern in this regard is the avoidance of lower back pain, a condition which though widespread in a chair-sitting society, is difficult to treat effectively.

Whether back pain is treated by such disciplines as orthopedics, neurology or neurosurgery, or by osteopathic or chiropractic practitioners, positive results are not often attained. An important cause of lower back pain are the chairs which induce this condition: an individual, who after being treated medically for lower back pain, returns to the chair responsible for this condition, experiences a recurrence of the back pain.

According to U.S. Pat. No. 4,331,360, faulty posture which results in an abnormal forward curvature of the spine in the lumbar region (lordosis) is the most common cause of lower back pain. Many chairs, identified as posture chairs, because they seek to avoid faulty posture, are expressly designed so that the lumbar curve of the seated individual is supported by the chair. Thus U.S. Pat. No. 5,735,574 discloses a posture chair having a lumbar support assembly movable in the fore and aft directions at the rear of the seat and being pivoted at a back support. U.S. Pat. No. 4,331,360 maintains that the theory that the lumbar curve must be supported by the back of a chair in order to avoid back pain.

To understand the etiology of lower back pain and why existing chairs are ineffective in avoiding conditions giving rise to such pains, one must first consider the structure of the spinal column and the form it assumes when an individual is sitting in a chair.

The spinal column, as shown in FIG. 1, is typically divided into four regions: cervical; thoracic; lumbar; and sacral. When viewed laterally, each of the four regions is described as forming a curve: the cervical and lumbar being convex towards the anterior; the thoracic and sacral being concave towards the anterior. These spinal curves permit humans to walk and stand as they do. The spine itself consists of vertebrae which comprise a bony body and bony processes, two transverse processes that project laterally and one spinous process that projects posteriorly. The purpose of the transverse processes is for attachment of muscles that support the spine. These processes and the body form the borders (or rim) of a canal which contains and protects the spinal cord. As shown in FIG. 1, the vertebral bodies that make up the lumbar region have a convex curve towards the anterior, as shown by line A. However, the spinous processes in the lumbar region terminate along line B, and hence in the posterior portion of the lumbar region there is no curve at the margin of the spine defined by the spinous processes but rather the margin defines a straight line.

The spine terminates in a non-movable joint at the pelvis, a bony ring made up of the sacrum of the spine, an ilium on each side, an ischium on each side and a pubis on each side. All of these bones are fused into a rigid ring; there is no movement between the pelvis and the sacrum (i.e., the sacroiliac joint). On each side of the pelvis is a socket (acetabulum) in which the head of the femur is inserted. When a human is standing, the weight of the upper body is vectored from the spine through the ilia to the hip joints; the ischia do not bear any of the weight of the body. When viewed from the side, a straight line can be drawn from the acetabulum through the superior portion of the iliac crest to the first cervical vertebra When an individual is seated in a chair so that his buttocks rest on the seat, then the load of his upper body weight is imposed on the ischia, or to be more exact, on the ischeal tuberosities (tuberosities are protuberances on the ischium).

The iliopsoas musculature extending between the femurs, pelvis, and the lumbar vertebrae acts to maintain the anterior lumbar curve when an individual is standing (i.e., an erect posture). In a standing individual, these lower back muscles exert forward tension on the lumbar spine to maintain its normal lordotic curve.

But while nature's design of the spinal column and its associated musculature is compatible with the postures normally assumed by primitive man who when not standing either rests on his haunches (squats) or sits cross-legged on the ground, nature did not anticipate the invention of the chair or bench, which compels its occupant to assume a sitting posture in which his buttocks rest on a seat elevated above the ground, with his thighs then extending forwardly from the seat, and his legs dangling from his thighs. The resultant sitting posture of the occupant of the chair is such that the load imposed by his upper body weight is mainly applied to the ischial tuberosities, thereby relaxing the associated iliopsoas musculature, whose function is to maintain the lumbar curve, causing relatively heavy stresses on the lumbar facet joints. It is these stresses which in time lead to lower back pain.

When stresses on the lower back are sustained for a prolonged period, as with an individual seated before a TV set for several hours, or before a computer terminal for most of a working day, lower back pain is then likely to develop to a degree that it then becomes difficult to alleviate. Moreover even if the lower back pain is successfully treated medically, it will recur should the individual return to the chair which caused the pain, or should the individual then occupy a chair similarly defective, ergonomically.

In the ergonomic design of a chair one must also take into account the gender factor. The reason for this is that in a male, the upper body weight relative to his weight below the waist is greater than in a female whose weight below the waist is more substantial that is, males have heavier upper body musculature and bones than females. Hence a chair, appropriate ergonomically for a male occupant, may not be as suitable for a female occupant.

SUMMARY OF INVENTION

In view of the foregoing, the main object of this invention is to provide a chair ergonomically designed to cause its occupant to assume a sitting posture conducive to his or her well being. More particularly, an object of this invention is to provide a chair of the above type which, when its occupant assumes a sitting position, acts to distribute the load imposed by the sitter so as to relieve stresses on the lower back, thereby obviating lower back pain.

Also an object of this invention is to provide an ergonomically designed chair that is adjustable to accommodate either a male or a female occupant.

Yet another object of the invention is to provide an ergonomically designed chair having arm rests whose angular position and height are adjustable to accommodate the occupant of the chair.

The state of the art is to prevent lower back pain from sitting by maintaining the lumbar region in an anteriorly curved position, such as with cushions or a permanent curve in the chair back, apparently in conformity with the lordotic curve. However, as shown above, the lordotic curve relates to the bodies of the vertebrae. In this invention, stress on the lower back and pelvis is alleviated by shifting the sitter's weight off the ischeal tuberosities and onto the lumbar spinous processes and the thighs. The lumbar spinous processes are supported by a linear (not a curved) back, and the seat of the chair is inclined backwards; that is,the front of the seat is elevated with respect to the back of the seat.

Briefly stated, these objects are attained in a chair ergonomically designed to cause its occupant to assume a sitting posture that acts to distribute the load of the sitter so as to relieve stress in the sitter's lower back, thereby obviating lower back pain. The seat of the chair which is slidable along a track that is upwardly inclined at a fixed angle relative to a horizontal plane. Hinged to the seat is a backrest that leans against an upright post at the rear of the chair. When an individual sits down to place his buttocks on the seat, he then slides the seat along the track until the backrest assumes an angle with respect to the seat at which it conforms to the sitter's back, the seat then being latched to maintain this condition. The configuration of the chair is such that the sitter's body assumes a position where the weight is taken off of the ischeal tuberosities and transferred to the lower back which is against and supported by the backrest and to the thighs by the angle of the seat. The resultant sitting posture of the individual is such that the load imposed by his upper body weight is to a substantial degree transferred away from the buttocks (ischeal tuberosities) to the thighs and back. As a consequence, stress on the lower back is relieved. Of course, should he change his activity, i.e. from computing to reading, he may change the position of the chair back but not the seat angle.

More particularly, the novel chair comprises a vertical column mounted on a base, a seat supported essentially horizontally on the column and having its anterior portion elevated from the posterior portion (i.e., is inclined), and a back attached to the posterior portion of the seat. In various preferred embodiments, the back is attached to the seat by a hinge, the seat is slidable anteriorly and posteriorly while maintaining its incline, there are optional armrests and an optional headrest, and the incline of the seat can be altered to accommodate both male and female occupants.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
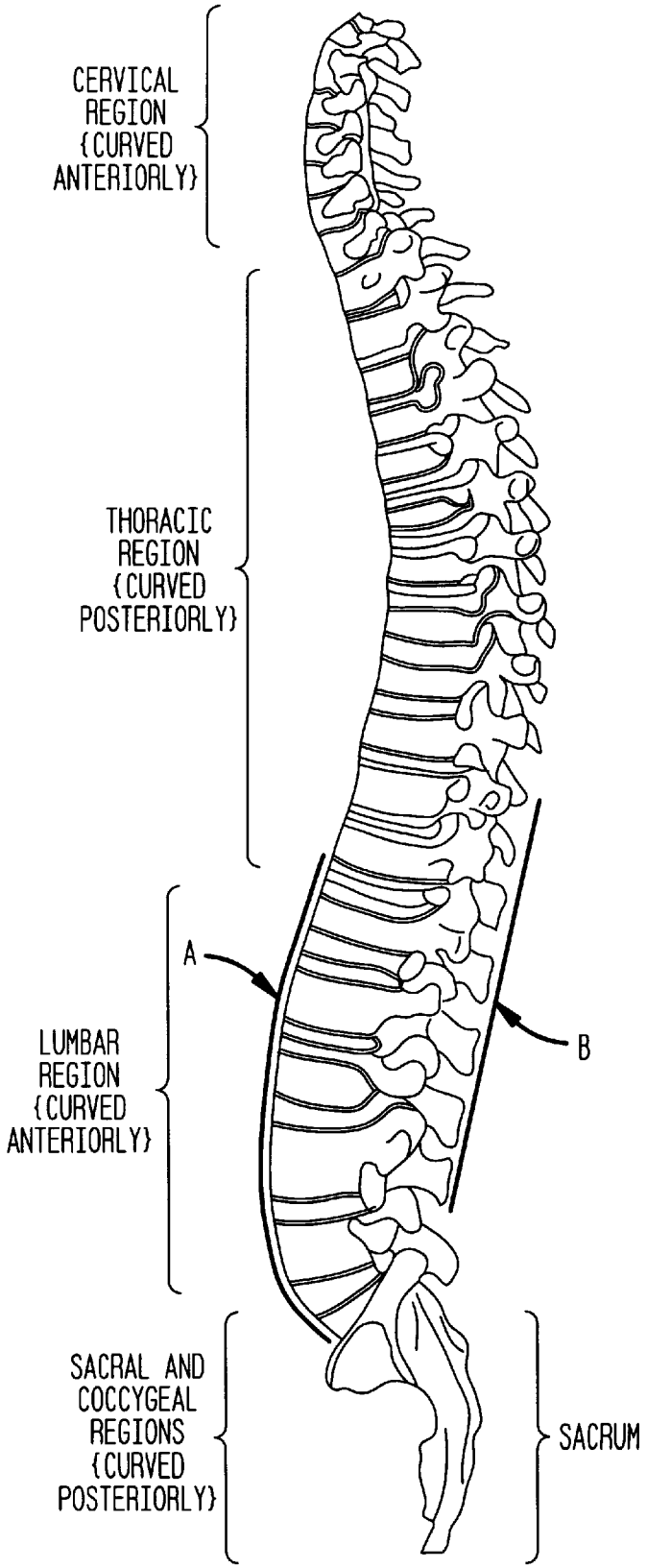
FIG. 1 is a lateral view of the spine.
Figure 2:
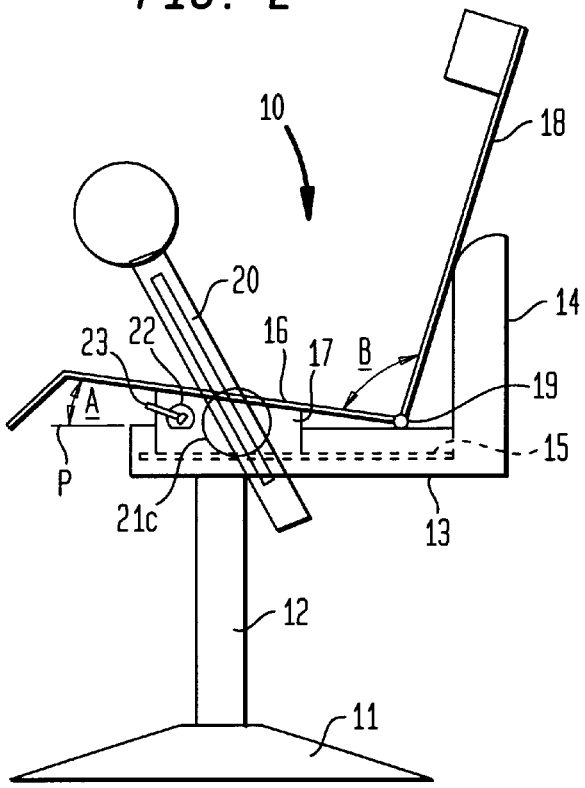
FIG. 2 schematically illustrates an ergonomically designed chair in accordance with the invention, as seen from one side.
Figure 3:
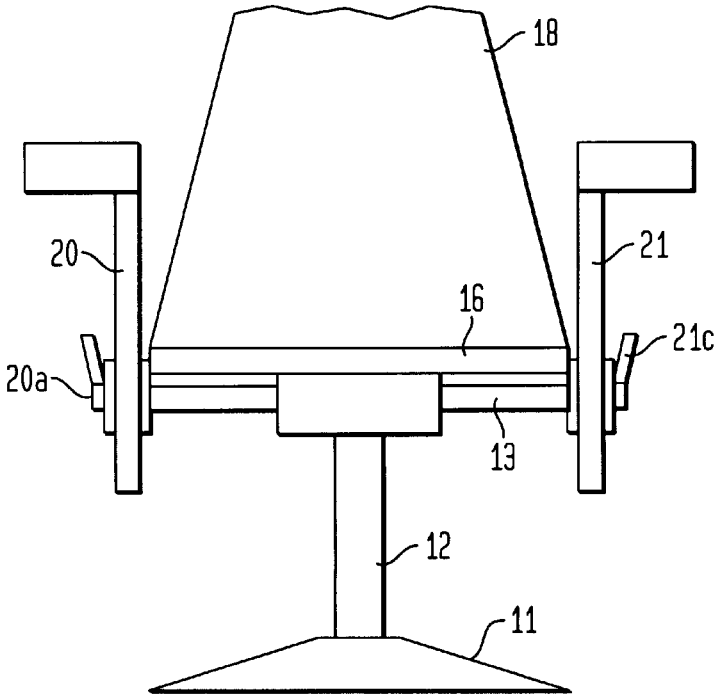
FIG. 3 is a front view of the chair.

Referring now to FIGS. 2 and 3, schematically shown therein is a chair 10 ergonomically designed to cause its occupant to assume a sitting posture that maintains his physical well being. This sitting posture brings about a redistribution of the load imposed by the weight of the sitter with respect to a conventional chair or bench so as to avoid having the ischeal tuberosities bear the body weight and to relieve stress on the lower back, thereby obviating lower back pain.

Chair 10 is provided with a pedestal 11 on which a vertical column 12 is anchored to support a frame 13, preferably disposed horizontally, at a raised position above the pedestal. At the rear of frame 13, and preferably attached thereto, is an upright support 14, preferably simply a post; in practice, this post may take the form of a U-shaped vertical hoop. Also, the chair may be provided with legs rather than a single vertical column.

Slidable along frame 13 along a track 15 is a carrier 17 on which is mounted a seat 16. Seat 16 is slidable from a forward position on frame 13 to a rear position adjacent upright post 14. The geometry of carrier 17 is such that its top face to which the seat is attached is upwardly angled with respect to a horizontal plane P parallel with the structure on which the chair is supported (e.g., the floor) so that seat 16 is angled upwardly with respect to this plane by a fixed angle A. This angle is maintained regardless of the position of the seat along the track.

The rear end of seat 16 is preferably hinged to the lower end of a backrest 18 by a hinge 19 so that the backrest leans against upright position 14 at an angle B relative to seat 16 which depends on the position of the seat along track 15. In the embodiment shown in FIG. 2, the backrest is wider at the bottom where it joins the seat and is narrower near the top. Because of the angle of the seat shifting the weight of the sitter to the area where the seat and backrest meet, the shoulders need not be supported.

Preferably, the height and/or length of the upright support 14 is adjustable vertically. Such adjustment determines the amount by which angle B will change as the seat is slid along the carrier. With a shorter upright support, the angle B can become quite obtuse as the seat is slid forward, whereas with a longer upright support, the angle B will change less drastically as the seat is slid forward. It is most preferable that, regardless of the actual height of the upright support, when the seat is slid to the rearmost position the backrest of the chair will be essentially vertical (i.e., the chair back will be colinear with the support, more preferably at 90° to the floor or other structure on which the chair is supported).

The reason a male sitter requires a greater seat angle is that his upper body weight relative to his weight below the waist is high, whereas the reverse is often true of a female sitter.

In a chair ergonomically designed for a male occupant, an angle A appropriate to this sitter lies in a 7 to 15 degree range. The seat angle in this range brings about the desired distribution of the load imposed by the upper body weight of the male sitter so as to relieve stress on the lower back and shift the weight so that it is not borne by the ischeal tuberosities, thereby obviating lower back pain. In a chair ergonomically designed for a female occupant, we have found that the seat angle range should be no higher than about 7 degrees, and preferably is at least about 3 degrees.

As shown in FIG. 2, the position of seat 16 on track 15 is such that the angle B between the rearwardly inclined backrest leaning against upright post 14 and the upwardly inclined seat is slightly greater than 90 degrees. Therefore when slidable seat 16 is shifted in the forward direction, angle B then increases, and when shifted in the rearward direction, it then decreases.

In practice, a head rest may be supported above the upper end of backrest 18. The angle and height of this head rest is adjustable to accommodate the occupant of the chair. Since the height of the occupant may be tall, short or medium, the location of his head with respect to the head rest depends on the occupant's stature. Preferably the head rest is positioned so that it contacts the bottom of the skull and the cervical region of the spine.

Pivotally attached to opposite sides of frame 13, or more preferably to the carrier 17, are arm rests 20 and 21. Each arm rest is angularly adjustable as well as being of adjustable length to best accommodate the arms of the particular chair occupant. The adjusted positions of the arm rests are maintained by clamps 20C and 21C. As shown by arrow 21R, the arm rotates around clamp 21C, the clamp fixing the arm through groove 21*g* that extends along the length of the arm. Similarly, the position of the arm in the direction of arrow 21L is determined by fixing the arm at a desired position along the groove 21*g*with the clamp 21C.

Carrier 17 is provided with a retractable latching mechanism 22 manually operated by a lever 23, button release, or the like, thereby making it possible for an occupant of the chair to latch the slidable seat at any desired position along the slide track, or to unlatch the seat so that it can be shifted to a different position. Such positioning is preferably provided by any means which allows positioning anywhere along the slide track, such as the aforementioned latch, or it may be accomplished using a worm gear, slide rod and dog (similar to a conventional locking mechanism for a screen door), or the like. While not as preferable, the carrier may be positioned at discrete locations, such as by means of a ratchet, or stops, or the like, in which case the discrete loctions are preferably spaced rather closely together (e.g., an inch or less between each). Discrete positioning is not optimal because of the large range of body geometries, and so a person may not find the position most suited to them, but such positioning is likely sufficient for the majority of the public.

The following preferred procedure is carried out so that the occupant of the chair is made to assume a comfortable sitting position. First, the individual must sit down so that his buttocks rest comfortably on the upwardly-inclined seat. Second, the occupant, with his buttocks on the seat, then slide the seat forward or backward until the backrest is in a position of comfort for the occupant (e.g., a different position may likely be more comfortable for computer work than for watching a movie). Third, the occupant must then latch the seat to maintain its position along the track.

In a conventional chair having a seat which lies in a horizontal plane and a backrest fixedly attached to the seat, the sitting posture of its occupant is such that the upper body weight of the sitter whose buttocks rest on the seat is mainly imposed on the ischial tuberosities. When sitting, the iliopsosas muscles, which maintain the lordotic curve, relax and no longer maintain the curve. As a consequence, a heavy stress is exerted on the lumbosacral spine, because normally the weight is carried by the hip joints and does not extend down to be borne by the ischial tuberosities. Thus, sitting in a conventional chair, or bench, for a prolonged period will lead to lower back pain, as previously explained.

The sitting posture assumed by an occupant of an ergonomically-designed chair in accordance with the invention in which the seat is upwardly angled relative to the horizontal plane and the back rest is angled relative to the seat so that it conforms to the back of the sitter, is such that the load imposed by the upper body weight is not mainly directed toward the ischeal tuberosities. Because of vector components, the load is so distributed that a substantial portion of the load is transferred to the thighs and spinous processes of the lower back of the sitter. By the combination maintaining the lower portion of the backrest linear and shifting the sitter's weight to that area, much of the upper body weight is borne by the lumbar region in its normal geometry; that is, a straight lower backrest will maintain the lumbar spinous processes in a linear geometry, whereby the bodies of the lumbar vertebrae maintain the lordotic curve.

FIG. 2 shows seat 16 upwardly inclined at a fixed angle A. But since the optimum fixed angle is not the same for male and female sitters, nor the same for sitters of different height and weight, in a practical embodiment chair 10 includes an adjustable mechanism to set the angle of inclination of the seat to an angle appropriate to the particular occupant of the chair. This can be accomplished by having an adjustment screw disposed vertically in the carrier to adjust the angle of the seat with respect to the support structure, or with respect to the frame. In one embodiment the seat has two positions, one for men and one for women, the former having an elevation of about 8° and the second having an elevation of about 3°.

Instead of having a chair with a horizontal frame 13, as shown in FIG. 2, in which case the slide carrier for the seat must have an angled upper surface, the frame itself may be upwardly angled, in which case the seat then slides along an angled track.

And in practice, the seat and backrest of the chair may be padded to enhance its comfort. Excessive padding is not required in the lower area and the chair is quite comfortable even for extended sitting periods; excessive padding may be detrimental to the sitter in the case that the padding does not maintain the lumbar spinous processes in a linear geometry. Also the height of the seat above ground should be made adjustable, to accommodate sitters of different stature. This adjustment should be such that the feet of the chair occupant rests on the ground.

As described, this invention can be modified for use in any environment in which a human must sit, including seats, chairs, and benches used in automobiles, buses, trains, planes, parks, places of worship, auditoria and theaters, and for typical household and office furniture. For example, the pedestal can be removed and the column permanently affixed to provide an airplane seat. As another example, the pedestal can be removed and column can be replaced by a plurality of columns attached to the frame, and those columns (or the pedestal if not replaced) can include casters or rollers.

Yet another modification is elimination of the sliding carrier and allowing the angle of the backrest to be adjusted as desired. This type of structure would be useful, for example, in an airplane, theater, or bus, which often have sitting devices where the seat is fixed but the backrest is movable. In such an embodiment, the backrest can be adjusted with the use of a worm gear or a ratchet mechanism.

While there has been disclosed an ergonomically designed chair in accordance with the invention, it is to be understood that many changes may be made therein without departing from the spirit of the invention.

I claim:

1. A chair ergonomically designed to have the load of a sitter there on distributed to the lower back and thighs and away from the ischeal tuberosities so as to relieve stress on the sitter's lower back, the chair comprising:

a frame raised above the ground provided at its rear with an upright post;

a seat slidable, parallel to the ground, and slidable on the frame toward said post, said seat being upwardly inclined relative to a horizontal plane defined by the ground and at a fixed angle thereto, and when the seat is slid the incline with respect to the horizontal plane remains the same;

a backrest hinged to the seat and leaning against the post, said backrest being at an angle to said seat that depends on the spacing between the seat and the post; and means to latch the seat to fix its position on the frame when an occupant sitting in the seat slides the seat toward the post until the backrest swings to conform to his back, at which position the occupant then assumes said sitting posture.

2. A chair as set forth in claim 1, in which said seat has a fixed angle in the range of 7 to 15 degrees.

3. A chair as set forth in claim 1, in which said seat has a fixed angle of about 0–7 degrees.

4. A chair as set forth in claim 1, in which said frame is raised above the ground by a vertical column anchored on a pedestal.

5. A chair as set forth in claim 1, in which arm rests are secured to said frame on opposite sides thereof.

6. A chair as set forth in claim 5, in which each of said arm rests is pivotally attached to said frame so that it may be angled with respect thereto.

7. A chair as set forth in claim 6, in which each of the arm rests is adjustable in length.

8. A chair as set forth in claim 1, provided with a head rest attached to said backrest.

9. A chair as set forth in claim 1, in which said frame is horizontal, and said seat is mounted on a carrier that slides along a track in said frame; said carrier having an inclined upper face to impart said fixed angle to the seat mounted thereon.

* * * * *

UNITED STATES PATENT AND TRADEMARK OFFICE

CERTIFICATE OF CORRECTION

PATENT NO. : 6,244,659 B1
DATED : June 12, 2001
INVENTOR(S) : Herbert A. Knapp

It is certified that error appears in the above-identified patent and that said Letters Patent is hereby corrected as shown below:

The patent is missing the following claims:

Claim 10,
A chair as set forth in claim 1, wherein the backrest is flat in the lumbar region of the sitter.

Claim 11,
A chair as set forth in claim 2, wherein the backrest is flat in the lumbar region of the sitter.

Claim 12,
A chair as set forth in claim 3, wherein the backrest is flat in the lumbar region of the sitter.

Claim 13,
A chair as set forth in claim 10, wherein the backrest is also flat in part of the thoracic region of the sitter.

Claim 14,
A chair as set forth in claim 11, wherein the backrest is also flat in part of the thoracic region of the sitter.

Claim 15,
A chair as set forth in claim 12, wherein the backrest is also flat in part of the thoracic region of thye sitter.

Claim 16,
A chair as set forth in claim 1, wherein said chair is adapted to be fastened to the floor of an automobile..

Claim 17,
A chair as set forth in claim 1, wherein said chair is adapted to be fastened to the floor of a bus.

UNITED STATES PATENT AND TRADEMARK OFFICE

CERTIFICATE OF CORRECTION

PATENT NO. : 6,244,659 B1
DATED : June 12, 2001
INVENTOR(S) : Herbert A. Knapp

It is certified that error appears in the above-identified patent and that said Letters Patent is hereby corrected as shown below:

Claim 18,
A chair as set forth in claim 1, wherein said chair is adapted to be fastened to the floor of an airplane.

Claim 19,
A chair as set forth in claim 1, wherein said chair is adapted to be fastened to the floor of a movie theater.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*